United States Patent [19]

Laughton

[11] 4,007,723

[45] Feb. 15, 1977

[54] ENGINE FRONT DISTRIBUTOR DRIVE SYSTEM

[76] Inventor: Kenneth Laughton, 15661 Rosales, Sylmar, Calif. 91342

[22] Filed: Nov. 5, 1975

[21] Appl. No.: 629,114

[52] U.S. Cl. ..... 123/148 R; 123/195 A

[51] Int. Cl.[2] ..... F02P 7/02

[58] Field of Search ..... 123/148 R, 195 A, 90.31

[56] References Cited

UNITED STATES PATENTS

| | | | |
|---|---|---|---|
| 2,867,202 | 1/1959 | Weissenbach | 123/195 A |
| 3,577,970 | 5/1971 | King | 123/90.31 X |
| 3,827,413 | 8/1974 | Meacham | 123/148 R X |

*Primary Examiner*—Robert G. Nilson
*Attorney, Agent, or Firm*—Howard A. Silber

[57] ABSTRACT

Engine timing fluctuations and intermittent loss of synchronization between the distributor and the timing gear are eliminated by this distributor drive system in which the distributor is mounted on a timing gear cover at the front of the engine. The distributor is driven from the timing gear via a drive disc and an adaptor shaft that are relatively axially moveable so as to isolate the distributor from axial cam shaft movement.

2 Claims, 5 Drawing Figures

Fig. 4
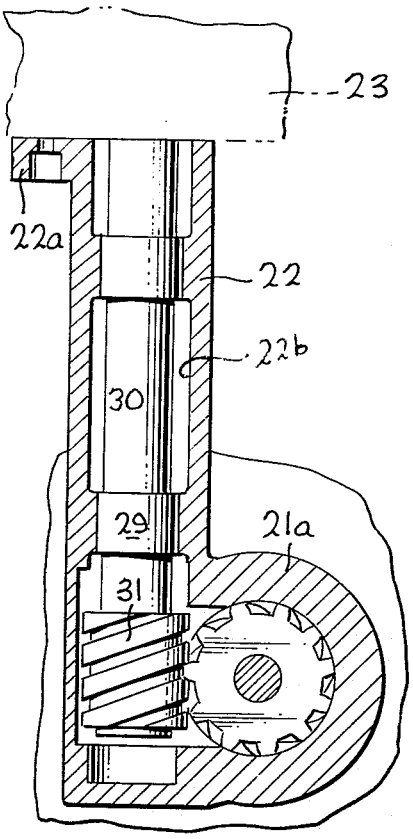
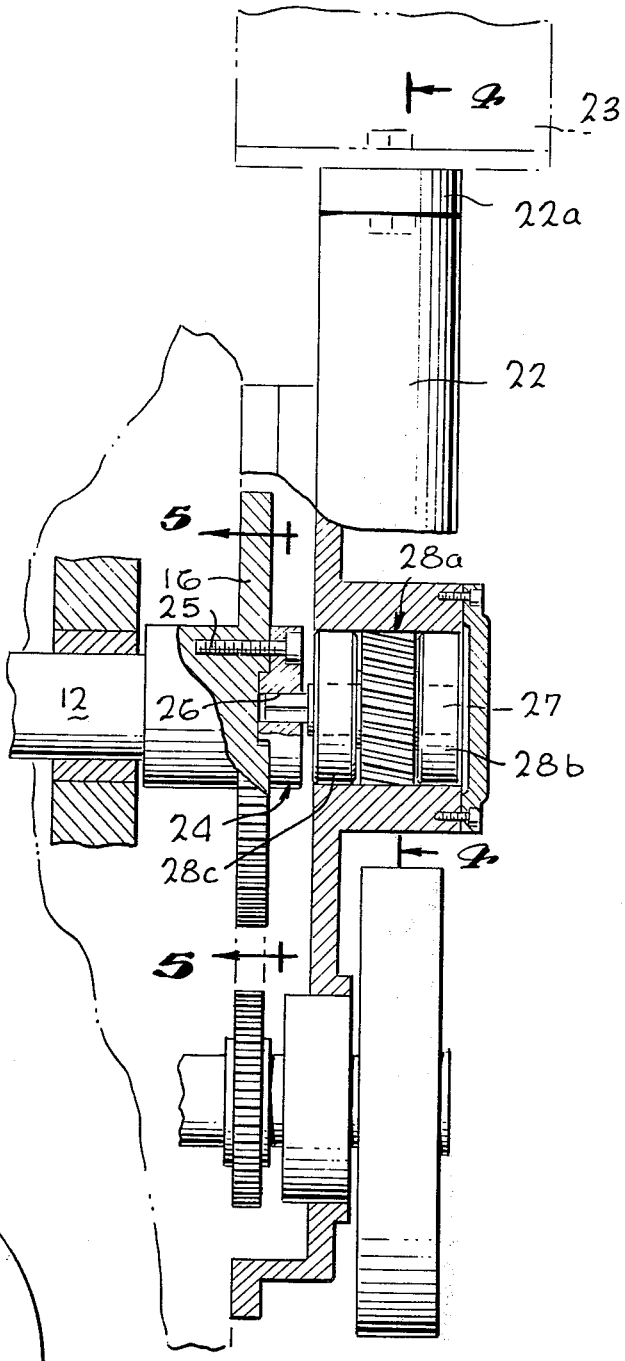
Fig. 5
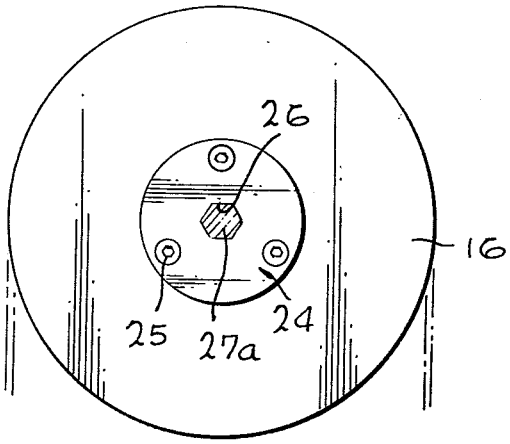
Fig. 3

ENGINE FRONT DISTRIBUTOR DRIVE SYSTEM

BACKGROUND OF THE INVENTION

1. Field of the Invention

The present invention relates to a distributor drive system mounted at the front of an engine and configured to eliminate timing fluction problems associated with a distributor mounted at the engine rear.

2. Description of the Prior Art

In certain automobile engines, the distributor is mounted near the rear of the engine housing and is driven from the rear of the cam shaft. The timing gear is mounted at the front of the engine housing and driven from the front of the can shaft. For optimum engine efficiency, the distributor must be synchronized with the timing gear. At low engine RPM the distributor and timing gear generally remain synchronized. However, at higher engine revolution rates three problems occur which cause the distributor to run out of sync with the timing gear. This results in less than optimal power output from the engine.

The first problem concerns the engine oil pump and its associated relief valve. The oil pump shares a common drive with the distributor. When the oil pressure exceeds a certain level, the relief valve opens to bypass the oil back to the pan. The oil pump continues to run, but does not pump oil. As a result, the load on the common distrubutor drive is reduced, causing a shift in the distributor orientation with respect to the cam shaft. Thus, while the engine is running at high speed, each time that the oil pump relief valve opens, the distributor is shifted out of sync with the timing gear. Timing fluctuation occurs, with concomitant loss in engine power.

The second, but related, problem is sometimes referred to as "cam walk". When the relief valve is closed so that the oil pump is pumping, the loading imposed by the operative oil pump actually causes an axial movement of the cam shift toward the front of the engine. A physical movement of 100 thousandths of an inch is typical. This movement shifts the position of the distributor cam sufficiently to vary the ignition timing as much as 10°, corresponding to a timing change of as much as 25%.

The third problem is known as "cam flex". In a typical engine the cam shaft is about 2 ½ feet long. Actual twisting can occur in this cam shaft, with the result that the distributor at the rear of the cam shaft is forced out of sync with the timing gear at the front of the cam shaft. Cam flex is particularly acute in a race car having heavy valve springs. Although the problem occurs at low engine RPM, the effect gets worse as the engine speed increases.

It is an object of the present invention to provide a distributor drive system that will eliminate these timing fluctuation problems.

SUMMARY OF THE INVENTION

In accordance with the present invention, these problems are overcome by providing a novel front drive ignition system wherein the distributor is mounted at the front of the engine. Since the distributor and timing gear both are situated at the same end of the cam shaft, the adverse timing effects of cam flex and intermittent oil pump loading are eliminated.

A distributor drive includes a relatively axially moveable linkage interconnecting the front end of the cam shaft and the distributor. This linkage isolates axial movement of the cam shaft so as to eliminate the cam walk problem.

BRIEF DESCRIPTION OF THE DRAWINGS

A detailed description of the invention will be made with reference to the accompanying drawings wherein like numerals designate corresponding parts in the several figures. These drawings, unless described as diagrammatic, or unless otherwise indicated, are to scale.

FIG. 3 is a side elevational view, partly broken away and in section, of the distributor drive system mounted on the front of an engine.

FIG. 4 is a transverse sectional view of the distributor drive system as seen along the line 4—4 of FIG. 3.

FIG. 5 is a front view of the distributor drive disc adapter mounted on the engine timing gear, as seen along the line 5—5 of FIG. 3.

DESCRIPTION OF THE PREFERRED EMBODIMENT

The following detailed description is of the best presently contemplated modes of carrying out the invention. This description is not to be taken in a limiting sense, but is made merely for the purpose of illustrating the general principles of the invention since the scope of the invention best is defined by the appended claims.

Figure 1:
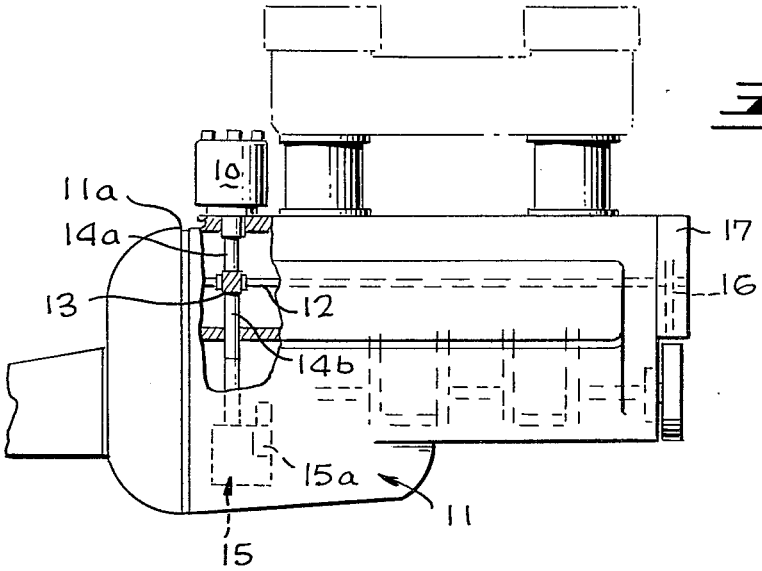
Fig. 1 PRIOR ART
FIG. 1 is a simplified pictorial view of an automobile engine showing the prior art distributor mounting arrangement at the rear of the engine.
Figure 2:
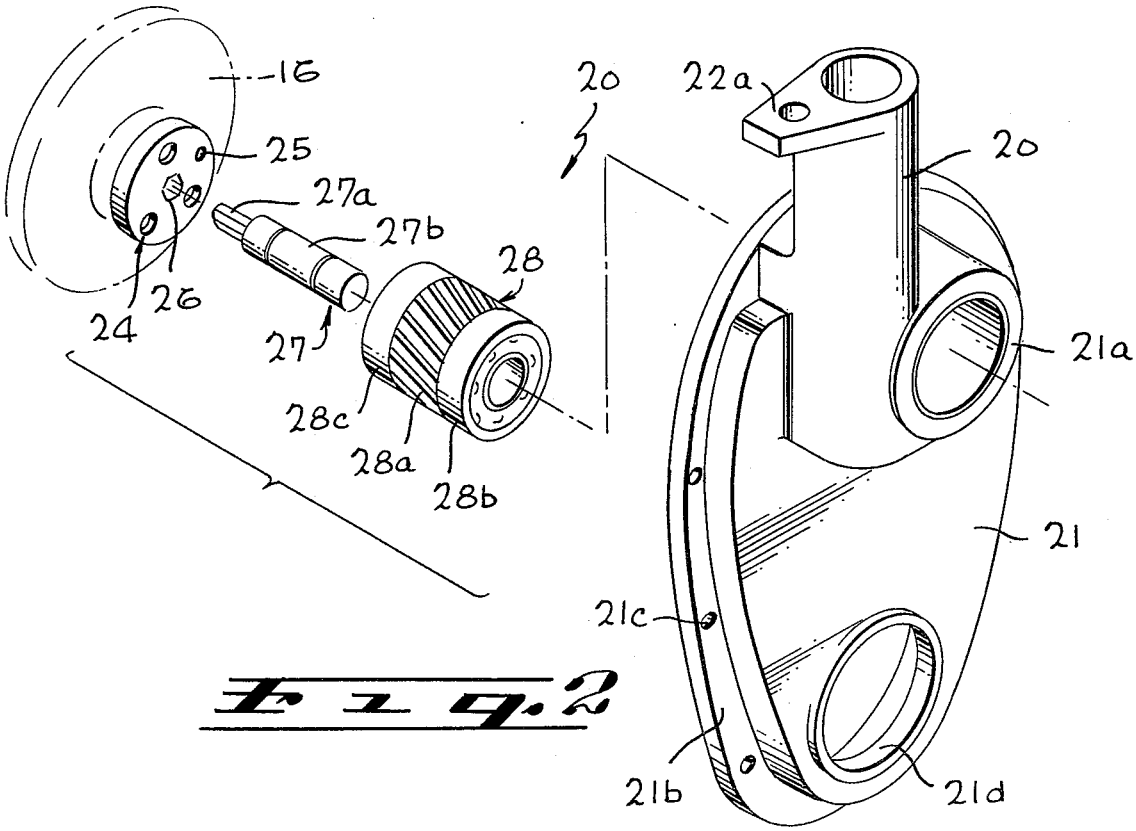
FIG. 2 is an exploded perspective view of the inventive distributor drive system.

A typical prior art distributor mounting is shown in FIG. 1. The distributor 10 is mounted atop the rear 11*a* of an engine 11 and is driven from the cam shaft 12 via a gear 13 and a vertical shaft 14*a*. The engine oil pump 15 also is driven from the cam shaft 12, as for example via the same gear 13 and a depending shaft 14*b*. This view is intended to be exemplary only, since the timing problems resulting from intermittent oil pump loading and cam walk may occur with a variety of different mechanical arrangements interconnecting the distributor 10 and the oil pump 15.

Associated with the oil pump 15 is a relief valve 15*a* that opens when the oil pressure exceeds a certain level. Oil then bypasses the pump 15 in a known manner and is returned to the oil pan. As described above, opening and closing of the relief valve changes the load imposed by the oil pump 15 on the distributor drive shaft 14*a*. This offsets the synchronization between the distributor 10 and the engine timing gear 16 that is situated within a cover 17 at the front of the engine 11. The intermittent loading of the oil pump 15 also causes cam walk, that is, an axial movement of the camshaft 12 toward or away from the front of the engine 11. This too, causes undesirable timing fluctuation.

Cam flex, that is, actual twisting of the cam shaft 12 also causes the angular orientation of the distributor 10 to be offset intermittently from the angular orientation of the timing gear 16. As a result, firing of the spark plugs, controlled by the distributor 10, is intermittently forced out of synchronism with entry of fuel to the engine cylinders, controlled by the timing gear 16. Loss of power results.

These problems are overcome by use of the inventive distributor drive system 20 shown in FIGS. 2–5. With this system, the distributor is mounted at the front of the engine 11 and is driven from the front of the cam shaft 12 but in a manner that isolates the distributor from axial movement of the cam shaft.

The system 20 includes a cover 21 that encloses the timing gear 16. The cover 21 has a cylindrical boss 21*a* that is in axial alignment with the timing gear 16 when the cover 21 is attached to the engine 11 via screws (not shown) that extend through holes 21*c* in a cover flange 21*b*. Another opening 21*d* is provided for other engine components that may project forwardly of the cover 21. Projecting upwardly from the boss 21*a* is a hemicylindrical cover section 22 terminating at a platform 22*a* on which is mounted the distributor 23.

A drive disc 24 is concentrically affixed to the front face of the timing gear 16 by means of screws 25. At the center of the drive disc 24 is a geometrically shaped bore 26 which may be of hexagonal cross-section.

An adaptor shaft 27 includes a correspondingly geometrically shaped projection 27*a* adapted for mating insertion into the drive disc opening 26. The projection 27*a* is integral and coaxial with a shaft section 27*b* that is journaled within a bearing 28, and keyed to a gear 28*a*. The outer bearing cylinders 28*b* and 28*c* seat in the cylindrical boss 21*a*, as shown in FIG. 3.

As shown in FIG. 4, a pair of bearings 29 are used to mount a distributor drive rod 30 within the cylindrical bore 22*b* through the vertical section 22. The upper end of the rod 30 is connected to drive the distributor 23. At the lower end of the rod 30, there is affixed a gear 31 which is driven by the gear 28*a* and hence by the adaptor shaft 27.

As the cam shaft 12 and timing gear 16 rotate, rotational motion is imparted to the distributor 23 via the drive disc 24, the adaptor shaft 27, the gear set consisting of the gear member 28*a* and the gear 31, and the drive rod 30. Since the distributor is driven directly from the timing gear 16, these will always be in synchronism, regardless of any twisting of the cam shaft 12.

Note that the adaptor shaft projection shaft 27*a* is free to move axially within the central opening 26 of the drive disc 24. Thus, if the cam shaft 12 should move axially, e.g., as a result of cam walk, this axial movement will not be transmitted to the adaptor shaft 27. The timing gear 16 and the drive disc 24 will move toward the gear and bearing assembly 28, and the adaptor shaft projection 27*a* will be more deeply inserted within the opening 26. However, this relative axial movement between the timing gear 16 and the gear assembly 28 will not affect the relative radial orientation between the timing gear 16 and the distributor 23. Thus, perfect synchronism between these two components will be maintained despite axial displacement of the cam shaft 12. Similarly, such exact synchronism will be maintained despite changes in the loading of the cam shaft 12 at the front end thereof, due to intermittent opening and closing of the oil pump relief valve 15*a*.

Intending to claim all novel, useful and unobvious features, shown or described, the applicant claims:

1. A system for driving the distributor of an engine from the front thereof, comprising:

a drive disc adapted to be concentrically affixed to the front face of the timing gear of said engine, said drive disc having a central, geometrically shaped bore therein, a cover adapted to be attached to the front of said engine, said cover having an integral mounting platform for said distributor, together with a cylindrical bore extending to said platform, a drive rod for said distributor journaled within said mounting platform bore, a gear set mounted within said cover and including one gear member affixed to said drive rod and a cooperating gear mounted for coaxial alignment with said timing gear and drive disc, and an adaptor shaft coaxially attached to said cooperating gear, said shaft having a correspondingly geometrically shaped projection adapted for mating insertion into said drive disc bore so that rotation of said timing gear and drive disc will rotationally drive said distributor via said adaptor shaft, said gear set and said distributor drive rod, said shaped projection being axially unattached to said drive disc so as to permit relative axial movement therebetween, whereby said timing disc and distributor will be driven in synchronism regardless of axial displacement or twisting of the engine cam shaft to which said timing gear is attached.

2. A distributor drive system according to claim 1 wherein said mounting platform comprises a generally hemicylindrical section projecting vertically upwardly from said timing cover, said cover including a bearing receiving cylindrical boss coaxially aligned with said timing gear, said cooperating gear being bearing mounted within said boss, said mounting platform boss extending through said vertically projecting section and opening into said cylindrical boss so that said one gear member and said cooperating gear mesh in said opening.

* * * * *